United States Patent [19]

Burns et al.

[11] Patent Number: 4,936,220

[45] Date of Patent: Jun. 26, 1990

[54] SOLID PROPELLANT-CARRYING CABOTED PROJECTILE

[75] Inventors: Bruce P. Burns, Churchville; Richard D. Kirkendall, Havre de Grace, both of Md.

[73] Assignee: The United States of America as represented by the Secretary of the Army, Washington, D.C.

[21] Appl. No.: 376,090

[22] Filed: Jul. 3, 1989

[51] Int. Cl.[5] ..... F42B 14/08

[52] U.S. Cl. ..... 102/521; 102/374

[58] Field of Search ..... 102/374, 376, 380, 520–523

[56] References Cited

U.S. PATENT DOCUMENTS

| | | | |
|---|---|---|---|
| H403 | 1/1988 | Glasser | 102/520 |
| 3,853,057 | 12/1974 | Rickert et al. | 102/521 |
| 4,284,008 | 8/1981 | Kirkendall et al. . | |
| 4,372,217 | 2/1983 | Kirkendall et al. . | |
| 4,542,696 | 9/1985 | Bisping et al. | 102/523 |
| 4,651,649 | 3/1987 | Nussbaum | 102/521 |
| 4,671,182 | 6/1987 | Zierler et al. | 102/521 |

FOREIGN PATENT DOCUMENTS

| | | | |
|---|---|---|---|
| 3428712 | 2/1986 | Fed. Rep. of Germany | 102/521 |
| 1016766 | 11/1952 | France | 102/520 |

*Primary Examiner*—Harold J. Tudor

*Attorney, Agent, or Firm*—Saul Elbaum; Paul S. Clohan

[57] ABSTRACT

A saboted projectile having an elongated sub-projectile having a double-ramp sabot mounted thereon. The sabot includes a main body portion having a radially extending forward scoop and a central bulkhead between which a toroidal-shaped cavity is formed. A self-sealing container extending between the scoop and the bulkhead encloses the cavity in which a solid propellant is contained. A through-hole, formed in the bulkhead, extends from the cavity to the rear surface of the bulkhead. The through-hole has an opening at the rear of the bulkhead for housing a blow-out plug. An igniter is mounted in the plug for igniting the solid propellant contained in the cavity after a predetermined delay. Ignition may also be achieved via pores or openings in the container which may contain a deterred propellant.

7 Claims, 2 Drawing Sheets

FIG. 7
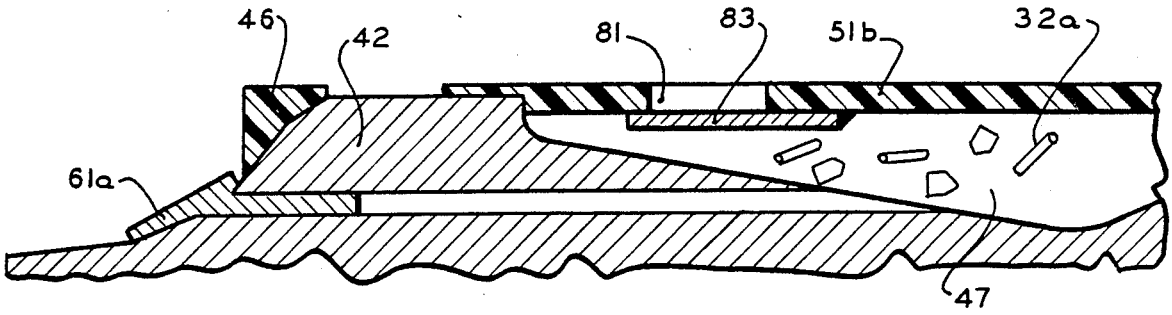
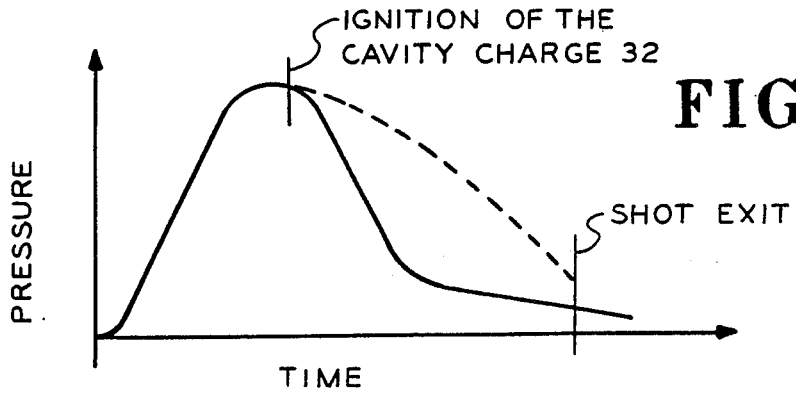
FIG. 5A
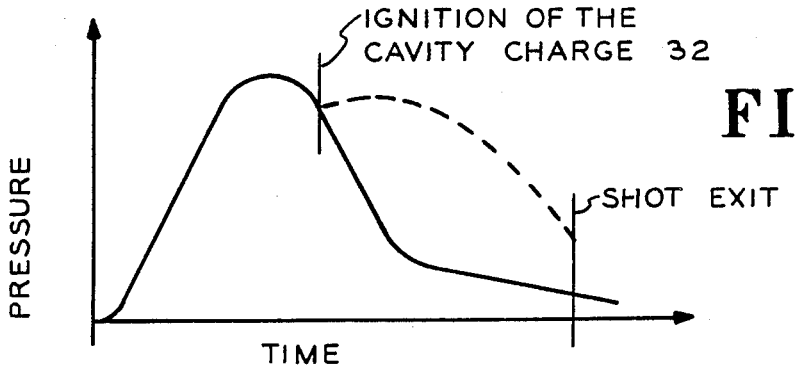
FIG. 5B

SOLID PROPELLANT-CARRYING CABOTED PROJECTILE

The invention described herein may be manufactured, used, and licensed by or for the Government of the U.S. of America for governmental purposes without the payment to me of any royalties thereon.

BACKGROUND OF THE INVENTION

1. Field of the Invention

The present invention relates to sabots for gun-launched projectiles and, more particularly, pertains to sabots having a solid propellant-carrying means for increasing the muzzle velocity of saboted projectiles.

2. Description of the Prior Art

In the field of ballistics, the sabot has found widespread use as a means of improving projectile velocity, accuracy and range. These improvements are possible in sabot-supported projectiles because the bore area on which the gun pressure acts is generally increased with only a relatively small increase in total projectile weight.

It has been long recognized that one of the most mass-efficient sabots presently used to launch kinetic energy projectiles from high performance guns are those constructed using the double-ramp principle. For practical reasons related to the initial centering of the projectile in the bore of the gun and the need to provide aerodynamic lift during discard, the most successful designs utilize a forward scoop. Such designs have been fully developed for use in the 25 mm chain gun used in the M2/M3 Bradley vehicle and in the 120 mm tank gun used in the M1A1 tank. Examples of sabots employing a forward scoop may be found in U.S. Pat. Nos. 4,284,008 and 4,372,213. Older, less efficient "saddle" designs, referred to in detail in these patents, also use a forward scoop. All of these designs have a common feature, an empty space or cavity between the rear of the forward-located scoop and the front of a bulkhead assemblage that contains the seat for the projectile obturator. When loaded in the bore of a gun, such space is bounded in the radial direction by the exterior of the sabot and the gun bore.

Attempts, utilizing liquid propellants, have been made to use this space to contain a traveling charge. These attempts, motivated by the hope of increasing the muzzle velocity of the projectile through ignition of this traveling charge, have, thus far, met with serious problems. One problem of major concern is the proper ignition of the liquid propellant. Proper functioning to attain the traveling charge effect involves pressurization of the space or cavity to eject the liquid out of the cavity into the space behind the projectile for combustion. This necessitates the introduction of high pressure gas channels to transport propellant gas from the rear of the sabot to the most forward portion of the cavity to force the liquid propellant from it, but without igniting it. Malfunctions related to the failure to maintain projectile integrity, probably caused by the forward ignition of the liquid propellant, have occurred.

Others have attempted to affix solid propellants to the rear taper of a sabot to generate a traveling charge, but difficulties in attaching the propellant to the sabot have occurred. In any event, such a device occupies space currently used for part of a conventional charge.

Consequently, those concerned with the development of sabot-supported projectiles have recognized the need for a means that effectively utilizes the existing space in mass-efficient sabots to store gun propellant. The use of such space for gun propellant will increase the amount of propellant available for propulsion thereby increasing the muzzle velocity of the saboted projectile. The present invention fulfills this need.

SUMMARY OF THE INVENTION

The general purpose of this invention is to provide a sabot-supported projectile wherein a solid propellant is introduced into the cavity of a modern sabot to allow more gun propellant to be efficiently used to enhance projectile velocity and to produce a traveling charge effect. To attain this, the present invention contemplates a sabot having a body section including means for mounting the sabot on an elongated sub-caliber projectile. The sabot body section has fore and aft surfaces that extend radially from the elongated body and terminate in bore-sliding surfaces. A cavity formed between the fore and aft surfaces contains a solid propellant. An igniter is mounted in the aft wall in conjunction with a means for permitting ignited gases to escape from the cavity toward the aft portion of the projectile. Combustion of the solid propellant is readily controllable based on well-known laws and dictated by the surface area of the propellant, it formulation, its burning rate and the time of ignition. The time of ignition is also easily controllable by a delay mechanism.

According to another aspect of the invention, ignition of the propellant in the cavity takes place as a result of gases from the main charge entering the cavity directly. Combustion delay is achieved by using deterred propellant.

It is, therefore, an object of the present invention to provide a saboted projectile having a solid propellant contained in a cavity with a controllable igniter.

Another object is to provide a means for preventing premature ignition of a solid propellant in a sabot cavity.

A further object of the invention is to provide a delay means to cause the solid propellant contained in the cavity to be ignited at the appropriate time.

Still another object is the provision of a self-sealing structure on the sabot to prevent propellant gas from flowing forward once the propellant in the cavity is ignited.

Yet a further object of the invention is the provision of means for containing the propellant in the cavity prior to loading.

Other objects and advantages of the invention will hereinafter become more fully apparent from the following detailed description when read in view of the annexed drawings, which illustrate a preferred embodiment.

BRIEF DESCRIPTION OF THE DRAWINGS

FIGS. 5A and 5B are graphs of pressure-time curves useful in understanding the present invention.

FIGS. 6 and 7 are sectional views showing modifications of certain details of the preferred embodiment.

DETAILED DESCRIPTION OF PREFERRED EMBODIMENT

Figure 1:
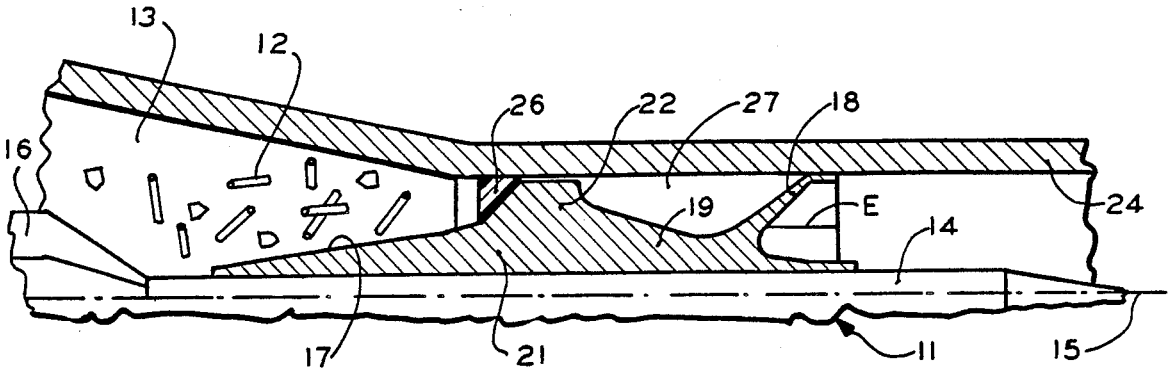
FIG. 1 PRIOR ART
FIG. 1 is a side elevation in cross section of a prior art device.

Referring now to the drawings, wherein like reference characters designate like or corresponding parts throughout the several views, there is shown in FIG. 1 a conventional double-ramp saboted kinetic energy projectile 11 just prior to the ignition of the main propelling charge 12 located in a gun breech 13. Saboted projectile 11 includes an elongated sub-projectile 14 generally of circular cross section throughout most of its body on which are attached stabilizing fins 16 at the aft section thereof. Sub-projectile 14 is generally symmetric about its longitudinal axis 15.

A double-ramp sabot 21 is fixed on the outer surface of the sub-projectile 14. Sabot 21 includes a rear ramp 17, a central bulkhead 22, and a forward ramp 19 from which extends a forward scoop 18. A main obturator 26 is mounted on the rear tapered surface of bulkhead 22. The sabot 21, like the sub-projectile 14, is symmetric with respect to the longitudinal axis 15. It is noted, therefore, that a toroidal-shaped cavity 27 is formed between the rear surface of the forward scoop 18, the front surface of bulkhead 22, the surface of the forward ramp 19 and the inner surface of the gun tube 24.

As mentioned above, the configuration shown in FIG. 1 depicts the position of the saboted projectile 11 just prior to ignition of the main propelling charge 12. Upon ignition of the charge 12, the sub-projectile 14 will be propelled by the combustion gases emanating from the propelling charge 12 impinging on the sabot 21 and the rear of the sub-projectile 14. At this point, the obturator 26, a resilient ring typically made of nylon, will be forced into sealing engagement between the inside surface of gun tube 24 and bulkhead 22, thereby preventing the combustion gases from passing between the sabot 21 and the gun tube 24.

Figure 2:
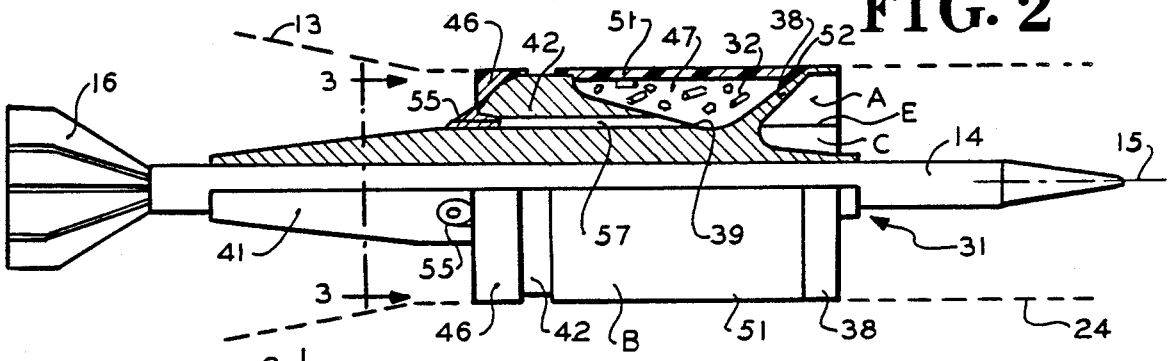
FIG. 2 is a side elevation of the preferred embodiment with the top half in section substantially taken on the line 2—2 of FIG. 3 and looking in the direction of the arrows.
Figure 3:
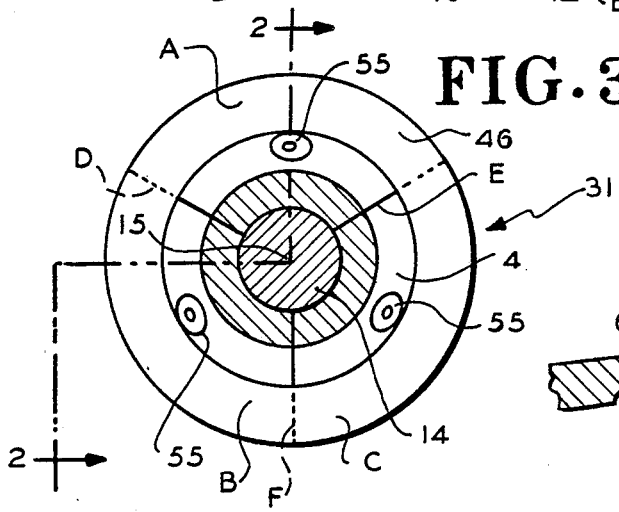
FIG. 3 is a cross section of the preferred embodiment taken on the line 3—3 of FIG. 2 and illustrating end views of portions of the sabot structure.

Referring now to FIGS. 2, 3, there is shown a saboted projectile 31 embodying the principles of the present invention. The saboted projectile 31 includes a sub-projectile 14, similar to that shown in FIG. 1, and a double-ramp sabot 41 fixed on the outer surface of the sub-projectile 14. Sabot 41 includes a forward scoop 38 and a central bulkhead 42, both extending radially to fill the gun tube 24, shown here in phantom for convenience. A ring-shaped obturator 46 is mounted on the rear tapered surface of bulkhead 42. The elements so far described with respect to FIGS. 2 and 3 may assume the same general configuration and will function in like manner as the corresponding elements depicted in FIG. 1.

In accordance with the principles of the present invention, the cavity 47, formed generally by the rear surface of the forward scoop 38, the surface of forward ramp 38 and the front surface of bulkhead 42, is shown filled with a solid propellant 32. A cylindrically-shaped, self-sealing container 51 covers the cavity 47 by extending between the outer surfaces of the forward scoop 38 and the bulkhead 42. The forward edge of container 51 includes a wedge-shaped seal 52 having a surface that lies against the tapered rear surface of the forward scoop 38. Seal 52 functions as an obturator to prevent gases from escaping forwardly from cavity 47. Effectively, the container 51 and cavity 47, in cooperation with the forward scoop 38 and the bulkhead 42, form a self-sealing, a propellant-carrying, toroidal-shaped canister.

As can be seen in FIG. 3, the sabot 31 is sectioned into a plurality of separate elements called "petals". While any number of petals may be employed, the present device, as shown in FIG. 3, has three. To form the three petals, the sabot is constructed of three identical sections A, B and C that rest against each other forming three seams D, E and F. Sections A, B and C are each identical and subtend an arc of 120° about the axis 15. As will be evident to those skilled in these arts, the sabot 31 is made of separate sections so that it may easily separate from the sub-projectile 14 after leaving the muzzle of the gun tube 24. The container 51 may be made of one piece to perform the function of holding the sections A, B and C in place (FIG. 3) prior to use. As such, the container 51 must also be made of an easily rupturable material such as nylon that will break up easily when the projectile 31 leaves the muzzle of gun tube 24 permitting the sections A, B and C to separate.

Figure 4:
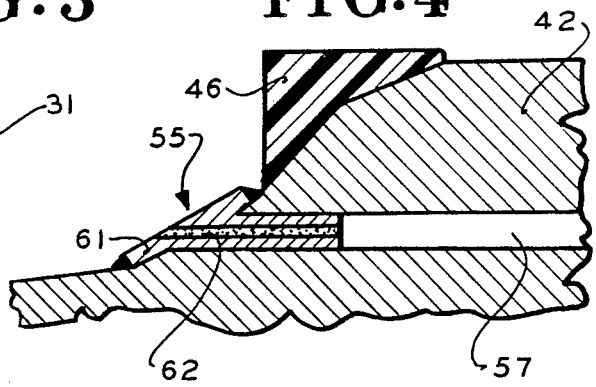
FIG. 4 is a cross section of a detail of the preferred embodiment shown in FIGS. 2, 3.

A plurality of igniters 55, one in each section A, B and C, are mounted in openings formed in the rear surface of bulkhead 42 that form one end of through-holes 57. The other end of through-holes 57 are open to the cavity 47. Now with particular reference to FIG. 4, there is shown a cross sectional blowup of the igniter 55. As seen in FIG. 4, igniter 55 includes a plug 61 with a flat head and having an ignition delay element 62 mounted in a longitudinal bore therein. The plug 61 is housed in through-hole 57 while the flat head is sealed to the sabot's exterior surface with a suitable sealant.

The operation of the device of FIGS. 2–4 is as follows: Upon ignition of the main charge 12 (not shown in FIG. 2) located in breech 13, the projectile 31 is thrust forward, causing the obturator 46 to be deformed by the interference fit between the bulkhead 42 and the gun tube 24 thereby forming the primary seal. Prior to effecting the primary seal, ignition of the propellant 32, located within the cavity 47, is prevented by the self-sealing container 51, which is designed to prevent such gas intrusion. The plug 61 is held in place by the unbalance of forces caused by the action of the propellant-generated pressure from the main charge 12 acting on its flat head. The unignited propellant 32 accelerates with the sabot 31 confined by the sabot 31 and the gun tube 24, with the self-sealing container 51 preventing ignition of the propellant 32 caused by friction between the sabot 31 or the propellant 32 and the gun tube 24. The ignition delay element 62 may be actuated by the acceleration of the projectile 32 or the pressure generated by the main propelling charge 12 or both. The delay element 62 may be constructed using pyrotechnic materials, electronic circuitry, mechanical devices, or a combination of methods. Such devices are readily available to those skilled in these arts. As one example, delay element 62 may simply be a pyrotechnic material that is ignited by the main charge and has a delay dictated by its burn rate. Another type of suitable igniter is disclosed by Bruce P. Burns in copending U.S. patent application Ser. No. 379,303, filing date 7-3-89, entitled "Temperature-Compensated, Acceleration-Activated Igniter", incorporated herein by reference.

At the appropriate time in the interior ballistic cycle, the delay element 62 causes an ignition pulse to be transmitted to the propellant 32 contained within the cavity 47, thereby igniting it. While the pressure builds within the cavity 47, the self-sealing container 51 expands against the gun tube 24 and against the forward scoop 38, forming a seal and preventing the generated gases from expanding.

The peak pressure on the forward scoop 38 will be significant, thereby requiring that it be substantially stonger than the conventional forward scoop 18 (FIG. 1). The strenghthening of forward scoop 38 may be achieved by using stronger materials or reinforcing elements or both. As the gas pressure within the cavity 47 rises, it will reach a magnitude wherein the force applied to the front of the plug 61 is greater than that generated by the main conventional charge 12 on the flat head, and cause the plug 61 to be expelled to the rear, opening the bulkhead 42 through-holes 57 to the passage of gas, combusting propellant, or both, and preventing the projectile 31 from failing due to runaway combustion in the cavity 47.

The effect of this invention on the interior ballistic cycle is demonstrated in FIGS. 5A and 5B, which may be tailored by the proper choice of ignition delay and propellant 32 selection. As the pressure generated by the main propelling charge 12 rises, normal interior ballistic behavior is achieved. The solid curve represents the pressure-time behavior for a prior art device (FIG. 1). If the propellant 32 located within the cavity 47 is ignited at the appropriate instant in the interior ballistic cycle, then the dashed curve beyond peak pressure will occur, thereby generating additional velocity by subjecting the projectile 31 to higher pressures during the expansion phase of the interior ballistic cycle. A more realistic curve is portrayed in FIG. 5B. Here an additional pressurization delay in cavity 47 is incorporated to prevent the possibility of over-pressure of the gun tube 24 or the projectile 31 under many launch conditions.

Calculations reveal that there is sufficient space within a typical cavity of a tank gun projectile to contain 3 to 6 lbs. of additional propellant. The added weight necessary to reinforce the forward scoop 38 would be on the order of 1 lb. Such parameters would result in an interior ballistic cycle wherein the charge-to-mass ratio is substantially improved for most of the projectile in-bore travel and approximately 70% of the in-bore travel time. A small penalty is paid during the very early phase of projectile travel wherein the net mass to be accelerated is increased by not only the extra mass introduced by reinforcing the forward scoop 38, but also by the mass of propellant 32 contained in the cavity 47. The extra mass of the self-sealing container 51 and the plug 55 with its special features (offset by the presence of the bulkhead through-holes 57) is negligible.

Figure 6:
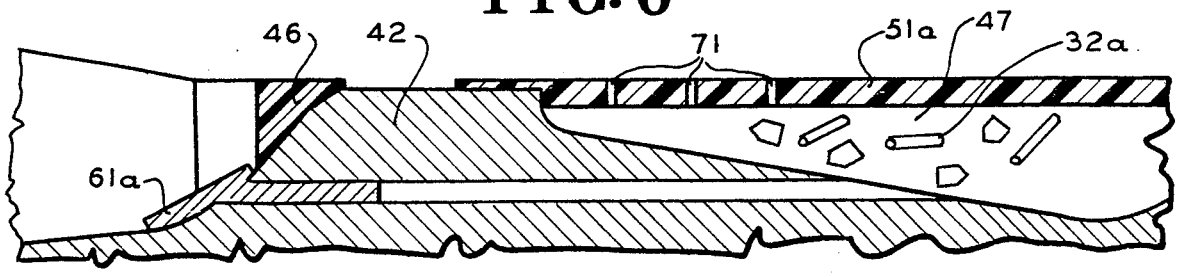

Obviously, many modifications and variations of the present invention are possible in the light of the above teachings. For example, additional combustion delay, over and above that afforded by delay element 62, may be achieved by using a deterred propellant for the propellant 32. The use of a deterred propellant when properly matched to the main charge may be useful in maintaining pressure within bounds set by system constraints. In many other applications where the use of a deterred propellant is suitable, the delay element 62 could be eliminated and ignition could be achieved at the time of initial combustion of the main charge. FIGS. 6 and 7 illustrate ignition structures wherein the delay element 62 is eliminated.

In FIG. 6 a modified container **51*a* has a number of pores 71 extending therethrough adjacent the bulkhead 42. Pores 71 are impervious to the propellant 32 but are previous to combustion gases from the main charge. In this case ignition of the deterred propellant 32*a* in the cavity 47 is achieved before the main obturator 46 is fully sealed by communicating hot propellant gas generated by the main charge to the cavity 47 via pores 71. The plug 61*a* is solid and will be expelled to permit combustion gases to escape from cavity 47. The FIG. 7 embodiment shows a one-way hole 81 formed in container 51*b*. A flap 83 hinged to the inside surface of container 51*b* covers hole 81 such that hot gases from the main charge can enter cavity 47. The flap 83 will prevent propellant 32*a* from spilling out of cavity 47. In both embodiments of FIGS. 6 and 7, the deterred propellant 32*a*** is selected to be matched to the main charge to afford proper combustion.

Obviously many other modifications and variations of the present invention are possible in the light of the above teachings. It is therefore to be understood, that within the scope of the appended claims, the invention may be practiced otherwise than as specifically described.

What is claimed is:

1. A saboted projectile comprising:

a sub-projectile having a body with a fore section, an aft section, an intermediate section, and a longitudinal axis extending along said body between said fore and aft sections;

a three-petal sabot having a body mounted on said intermediate section and extending transversely of said longitudinal axis to form solid fore and aft transverse walls and defining a cavity therebetween;

a solid propellant contained in said cavity;

three through-holes formed in said solid aft wall extending from said cavity in a direction toward said aft section;

a self-sealing container extending between said solid fore and aft transverse walls to completely enclose said cavity, said container including an obturator means mounted adjacent said solid fore transverse wall for sealing said cavity to prevent combustion gases from escaping from said cavity toward said fore section;

three unsealable plugs for sealing said through-holes and an ignition delay element mounted in each of said plugs whereby said solid propellant contained in said cavity is ignited at a predetermined time after said projectile is fired thereby unsealing said three unsealable plugs when the pressure in said cavity is greater than the pressure adjacent said aft section by a predetermined amount and permitting gasses to escape through said three through-holes.

2. The device of claim 1 wherein said ignition delay element delays combustion of said propellant to a point beyond peak pressure of the interior ballistic cycle.

3. The device of claim 1 wherein said cavity is toroidal-shaped and is symmetrically disposed about said longitudinal axis.

4. The device of claim 1 wherein said solid propellant weighs three to six pounds.

5. The device of claim 4 wherein said three to six pounds of solid propellant is a deterred propellant.

6. The device of claim 1 wherein said ignition delay element is actuated by the acceleration of said projectile.

7. The device of claim 1 wherein said ignition delay element is actuated by the pressure generated by the main propelling charge of said projectile.

* * * * *